United States Patent [19]

Marshall

[11] 4,183,995

[45] Jan. 15, 1980

[54] OCTA-DIRECTIONAL NONWOVEN FABRIC

[75] Inventor: Preston F. Marshall, Walpole, Mass.

[73] Assignee: The Kendall Company, Boston, Mass.

[21] Appl. No.: 944,424

[22] Filed: Sep. 21, 1978

[51] Int. Cl.[2] ..... B32B 1/00

[52] U.S. Cl. ..... 428/284; 428/286; 428/290; 428/343; 428/354; 428/910

[58] Field of Search ..... 428/288, 284, 286, 290, 428/292, 293, 294, 357, 910, 343, 354

[56] References Cited

U.S. PATENT DOCUMENTS

| | | | |
|---|---|---|---|
| 2,862,251 | 12/1958 | Kalwaites | 428/357 |
| 3,969,561 | 7/1976 | Marshall | 428/113 |
| 4,068,047 | 1/1978 | Dangel et al. | 156/309 |

*Primary Examiner*—James J. Bell

*Attorney, Agent, or Firm*—Edward J. Scahill, Jr.

[57] ABSTRACT

An unlayered nonwoven fabric has a uniformly repeating pattern of high fiber density areas, each surrounded by low fiber density areas. The low fiber density areas inconnecting the high fiber density areas are composed of substantially parallelized strands of fibers entering into the high fiber density areas from at least eight directions. These octadirectionally oriented nonwoven fabrics have advantageous tear characteristics, and by the nature of the uniform cover factor of the web, they have many desirable and advantageous uses.

10 Claims, 5 Drawing Figures

OCTA-DIRECTIONAL NONWOVEN FABRIC

BACKGROUND OF THE INVENTION

This invention relates to biaxially oriented nonwoven fabrics and more particularly to nonwoven fabrics having low fiber density and high fiber density areas and their uses as adhesive tape substrates and the like, wherein said high fiber density areas have low fiber density strands of fibers entering therein from at least eight different directions, each of said strands having substantially parallelized fibers therein.

In U.S. Pat. No. 3,969,561, of common assignee, a biaxially oriented nonwoven fabric was described; however, this was essentially a striped fabric of alternating high and low fiber density stripes, the fibers of the alternating stripes being oriented substantially normal to the other. While this fabric has an improved tensile strength, its tear strengths in the machine direction and cross direction are not equal or even nearly so. If one were to attempt to tear straight across the fabrics, it would be nearly impossible to achieve.

A prior art product that has a somewhat similar appearance to this invention is described in a number of patents of which U.S. Pat. No. 2,862,251 is typical, particularly with reference to FIGS. 49–58. This patent teaches how to make a tufted apertured three-dimensional fabric having budded protuberances, consolidated "flat pack ribbons" extending in the direction of the general orientation of the web fibers, and smaller consolidated "flat bundles" which extend between immediately neighboring buds in a direction generally transverse to the direction of main fiber orientation. By starting with an isotropic web, an element of parallelism is introduced in as many as six (6) directions emanating from the tufted three-dimensional bud portions. Using this method, a uniform web is first formed, treated and then rearranged by hydraulic forces. However, it should be apparent to those looking at the products described therein that all of the products produced thereby result in an apertured and tufted fabric. The apertures or holes in the fabric reduce the fabrics usefulness for many purposes, while the tufts restrict the uniform tearability of the fabric.

Accordingly, it is an object of this invention to produce a fabric having easy tear characteristics in both the cross and machine directions of the fabric so as to facilitate the use of this fabric as a substrate for medical and industrial adhesive tapes, other tape products and other materials and products where such characteristics are important.

Another object of this invention is to provide an aesthetically pleasing, light-weight, octa-directionally oriented and highly drapeable fabric.

A further object of the instant invention is to produce a fabric having all of the above desirable characteristics in a light-weight nonwoven fabric that is rather "uniformly covered" and is substantially free of apertures.

Still another object is to produce a fabric that can be used as a spacer in a composite structure wherein approximately $16\frac{2}{3}\%$ to 25% of the area of the space fabric acts as the thick spacing material.

SUMMARY OF THE INVENTION

An octa-directionally oriented nonwoven fabric can be made having high fiber density areas and low fiber density areas, said high fiber density areas being formed by the intersection therethrough of a plurality of substantially parallelized strands of fibers entering said high density area from at least eight directions; said high fiber density areas having a randomized orientation but being spaced apart in a uniformly patterned manner with respect to each other, said low fiber density areas being composed of strands of fibers interconnecting said high fiber density areas and having a plurality of varied parallelized fiber orientations therein. This rather light-weight fabric has a multitude of end uses including its use as a backing or substrate for adhesive tapes, due to its equal tear strengths in the machine and cross directions. The fabric is highly drapeable and relatively lint-free.

DESCRIPTION OF THE PREFERRED EMBODIMENTS

Figure 1:
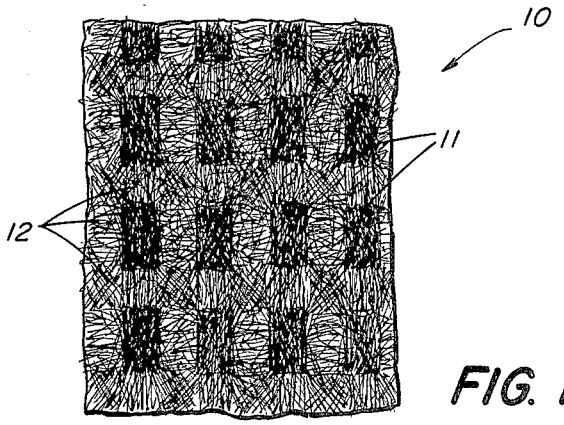
FIG. 1 is a plan view of a nonwoven fabric produced in this invention.
Figure 2:
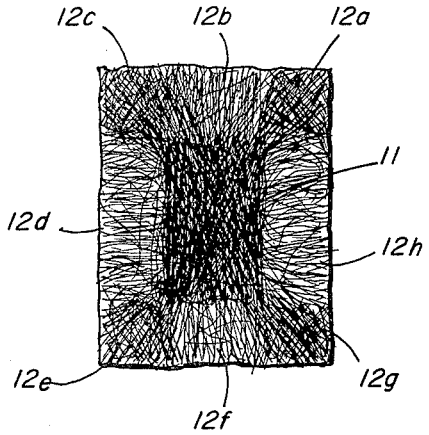
FIG. 2 is an exaggerated plan view of one high fiber density area of this nonwoven fabric and its eight attendant low fiber density areas.

Referring to FIGS. 1 and 2 of the drawings, there is shown a nonwoven fabric 10 having high fiber density areas 11 composed of fibers emanating from at least eight different directions and intersecting at this home base thereby producing the high fiber density areas denoted herein as 11. The high fiber density areas 11 are substantially surrounded by at least eight substantially parallelized strands of fibers, entering from at least eight different directions. These strands of low fiber density areas are denoted, in FIG. 2, as 12*a, b, c, d, e, f, g,* and *h.* While FIG. 2 shows these parallelized strands of fibers as being rather strictly formed, it should be emphasized that the parallelism shown is exaggerated for purposes of illustration. Actually, the fibers or strands of fibers are in reality somewhat more spread out, thereby substantially eliminating any incidence of defined apertures from occurring in the nonwoven fabric. Accordingly, this nonwoven fabric can be seen to be more "uniformly covered" than, for example, the fabrics shown in U.S. Pat. No. 2,862,251, which show a somewhat similarly appearing web.

Figure 3:
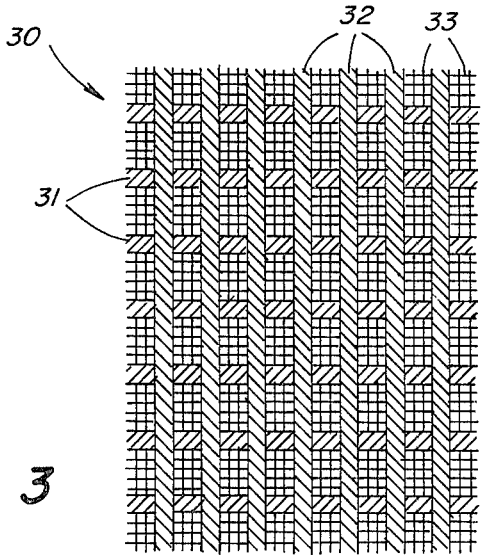
FIG. 3 is a plan view of the conveyor screen covered by the striping bars and tapes utilized in this invention.

Referring to FIG. 3, there is shown a conveyor screen 30 having resist areas 31 disposed on the screen, from one side to the other side. These resist areas 31 can advantageously be an adhesive tape material, or the like, disposed directly on the screen. Such a screen could be used in an apparatus such as is described in U.S. Pat. No. 643,553 filed on Dec. 22, 1975 (a division of U.S. Pat. No. 3,969,561, of common assignee), to produce the nonwoven fabrics described therein.

The apparatus used and described in the referenced patent application consists of the use of a high velocity fluid-borne stream of textile-length fibers in an air-lay device. The stream of fibers are guided through a venturi and passed on into a curved distributor chamber, further aided by free air pulled in from outside the chamber, and is thrown onto a moving conveyor screen disposed thereunder. U.S. Pat. No. 3,969,561 discloses the fabric produced by the use of the above apparatus that has finger-like striping bars disposed at regular intervals across the width of the moving screen, using a suction box as an aid in causing the fluid-borne stream of fibers to be directed at the striping bars.

If similar striping bars, such as shown as 32 herein, were to be placed within the distributor chamber described above oriented in the machine direction (the direction of the moving conveyor), so as to be at approximately right angles with the resist areas 31 already disposed on the screen, the nonwoven fabrics disclosed herein would be produced.

It has been found that fluid-borne streams of textilelength fibers disposed on the screen described in FIG. 3, and used in conjunction with the above-described apparatus, unexpectedly causes the fibers deposited on the screen to become oriented in at least eight different directions, while at the same time, further causes the fibers to intersect, overlap and interact with each other forming high fiber density areas in a uniformly patterned manner such as shown in FIG. 1. Accordingly, the rather randomized high fiber density areas 11 appear to have low fiber density parallelized strands of fibers radiating out therefrom in at least eight different directions. It should be noted that the strands of fibers connecting the randomized high fiber density areas to each other become somewhat spread out and not as clearly defined as shown in the drawing, crisscrossing over one another so as to rather uniformly cover the surface of the conveyor screen 30. This characteristic of the formed web enables the web to be used in a number of applications where a continuous web surface is important. Some prior art webs mentioned earlier herein contain many apertures, imparting a rather discontinous web surface that eliminates many possible product applications.

It is interesting to find that not only is an aesthetically pleasing web produced thereby, but, further, the web produced can more easily be torn, lengthwise or widthwise, along a relatively straight line, and is highly drapeable. This is due primarily to the "equi-strength" tear characteristics of the web due to the octa-directional orientation of the fibers in this uniform manner. It should further be pointed out and emphasized that the fabrics produced hereby are of a very lightweight (usually less than 15 grams per square yard) and have unusually high strength characteristics for such light weight webs and are produced without any significant interlooping, interentanglement or the like, such as was described in U.S. Pat. No. 2,862,251 and other related patents. Furthermore, because of the rather uniform disposition of the fibers within the web and because of the rather uniform cover of the web surface, the fabrics produced herein can be most advantageously used for a variety of purposes.

Figure 4:
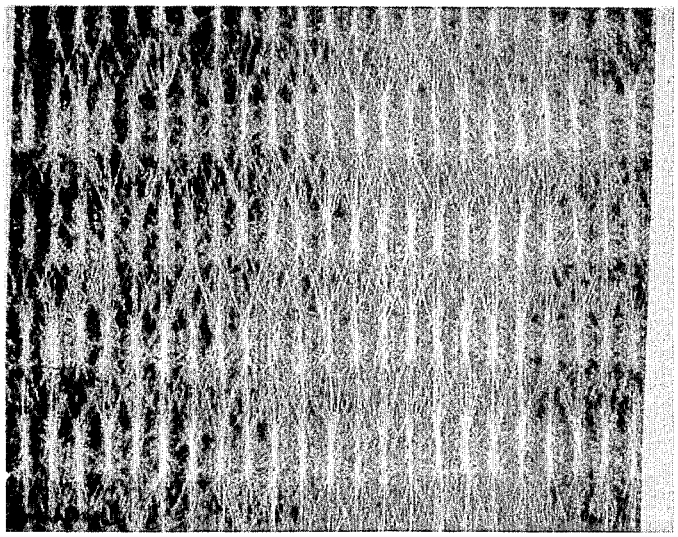
FIG. 4 is a photograph of a typical nonwoven as depicted in FIG. 1 of the drawings.
Figure 5:
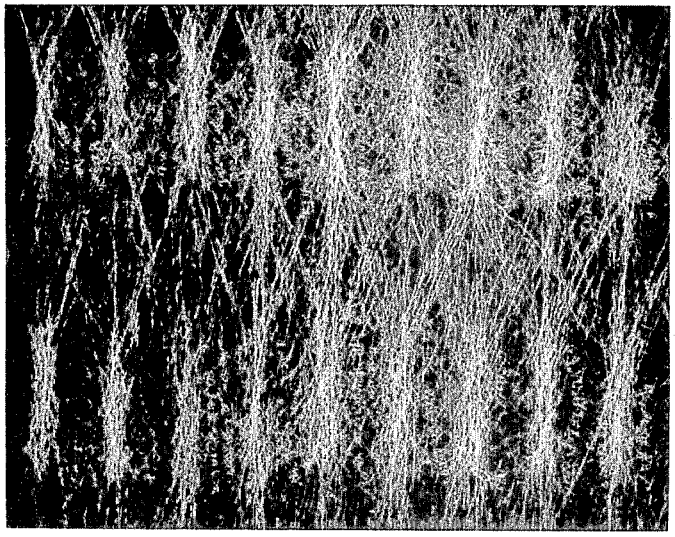
FIG. 5 is a close-up of the fabric shown in FIG. 4.

FIGS. 4 and 5 are photographs that are illustrative of typical nonwoven fabrics of this invention. As pointed out earlier, the drawings contained herein have been somewhat exaggerated to make a point concerning the fiber orientations within these webs. However, these photographs more accurately show the orientation of the fibers. It can still be seen, however, that the surface of the nonwoven is substantially free of apertures—not nearly so open as the fabrics described in U.S. Pat. No. 2,862,251. It can also be seen that the high fiber density areas are randomly oriented and are spaced apart from each other in a rather uniformly patterned manner by the varying orientations of the low fiber density areas.

If one were to attempt to evenly tear the fabrics shown in U.S. Pat. No. 2,862,251, either across the fabric or up and down along the length of the fabric, they would be faced with a very difficult, if not impossible, situation. Furthermore, if that fabric were to be used as a substrate for a tape material or the like, or any application in which the presence of the apertures is a disadvantage, then the fabric disclosed therein would be of little or no use.

It has now been found, however, that the fabrics produced herein can be torn on relatively straight lines both across the fabric as well as along its length. Also, due to the substantially uniform cover factor of this web, it can be used as, for example, a substrate for an adhesive tape, medical, industrial or the like.

The invention can, perhaps, be further illustrated by way of the following example:

EXAMPLE

Eight ends of 38,265 denier rayon silver of 3 denier per filament ½" long were fed into a fluid-borne stream through eight jet nozzles at an air pressure of approximately 17 psig. The stream passes into a curved distributor chamber and the stream of fibers is thrown onto a moving conveyor screen such as shown in FIG. 3, wherein the resist areas 31 consists of ¼" side tapes placed across the conveyor screen on ½" centers. Striping bars, such as 32, were placed within the curved chamber with the bars oriented in the machine direction. These striping bars were approximately ⅛" wide on 3/16" centers. The fabric produced herein is highly drapeable, weighs about 7.0 grams per square yard and has a rather uniformly covered surface, while the tear strength in the machine direction is 156 grams, and the tear strength in the cross direction is 150 grams. It should also be pointed out that the tensile strength of the fabric is fairly good in both machine and cross direction due to the varied fiber orientations within the fabric.

While the fabrics of this invention can be bonded together by any conventional means, a conventional liquid polymeric binder is preferred. Also, it is possible to saturate the unbonded web with a pressure sensitive adhesive as the fabric comes off the nonwoven line. Such a treated web could be sandwiched between layers of coated release paper, or the like.

Of course, in addition to the fabrics described above, those and other fabrics can be used in conjunction with each other and with other fabrics to be laminated together or the like. For example, these fabrics could be placed on a paper tissue-like material, laminated together and used in a variety of tape applications, as a surgical sponge, wipe, surgical gown, or the like. The fabric of this invention is aesthetically pleasing and has many advantageous characteristics as outlined above.

Since it is obvious that many modifications and embodiments can be made in the above-described invention without changing the spirit and scope of the invention, it is intended that this invention not be limited by anything other than the appended claims.

What is claimed is:

1. A nonwoven fabric having octa-directionally oriented fabric strands comprising:

an unlayered nonwoven web having substantially no apertures therein and having a repeating pattern of high fiber density areas, each of which are surrounded by low fiber density areas;

said low fiber density areas interconnect said high fiber density areas and are composed of substantially parallelized strands of fibers entering into and overlapping in said high fiber density areas from at least eight directions;

said high fiber density areas having a randomized orientation and being spaced apart from each other in a uniformly patterned manner by said low fiber density areas, said randomized orientation being caused by said parallelized strands of fibers overlapping in said high fiber density areas from at least eight directions.

2. The nonwoven fabric of claim 1 wherein said fabric is bonded by means of a polymeric binder.

3. The nonwoven fabric of claim 1 wherein said fabric weighs less than 20 grams per square yard.

4. The nonwoven fibers of claim 1 wherein said nonwoven fabric is composed of textile length rayon fibers.

5. The nonwoven fabric of claim 1 wherein said nonwoven web is laminated to at least one ply of cellulosic material.

6. The nonwoven fabric of claim 1 wherein said fabric is saturated with a pressure sensitive adhesive composition.

7. The nonwoven fabric of claim 4 wherein said laminate is bonded by means of heat and pressure.

8. The nonwoven fabric of claim 4 wherein said laminate is bonded together by means of a liquid binder.

9. A pressure sensitive adhesive tape comprising:

an unlayered nonwoven web having substantially no apertures therein and having a repeating pattern of high fiber density areas, each of which are surrounded by low fiber density areas;

said low fiber density areas interconnect said high fiber density areas and are composed of substantially parallelized strands of fibers entering into and overlapping in said high fiber density areas from at least eight directions;

said high fiber density areas having a randomized orientation and being spaced apart from each other in a uniformly patterned manner by said low fiber density areas, said randomized orientation being caused by said parallelized strands of fibers overlapping in said high fiber density areas from at least eight directions;

a pressure sensitive adhesive composition impregnated throughout said nonwoven web.

10. The tape of claim 9 wherein said impregnated nonwoven is covered on both sides by a releasable sheet material.

* * * * *